US006207919B1

(12) United States Patent
Davis

(10) Patent No.: US 6,207,919 B1
(45) Date of Patent: Mar. 27, 2001

(54) LOAD BREAK INTERRUPTER HAVING SHUNT CIRCUIT BREAK ACTUATING MECHANISM

(75) Inventor: Brad W. Davis, Columbia, MO (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/454,572

(22) Filed: Dec. 7, 1999

(51) Int. Cl.[7] ..... H01H 33/02
(52) U.S. Cl. ..... 218/157; 218/67; 218/84
(58) Field of Search ..... 218/7, 12, 13, 218/14, 67, 84, 75–6, 78, 89, 118–120, 154–158

(56) References Cited

U.S. PATENT DOCUMENTS

| | | | | |
|---|---|---|---|---|
| 2,710,897 | | 6/1955 | Lindell . | |
| 2,923,799 | | 2/1960 | Polgov et al. . | |
| 3,223,810 | | 12/1965 | Jelinek . | |
| 3,471,669 | | 10/1969 | Curtis . | |
| 3,739,122 | | 6/1973 | Pierzehala . | |
| 3,909,570 | * | 9/1975 | Harner et al. | 218/155 |
| 4,011,426 | | 3/1977 | Lange . | |
| 4,013,852 | | 3/1977 | Roberts et al. . | |
| 4,103,129 | * | 7/1978 | Evans et al. | 218/154 |
| 4,459,447 | | 7/1984 | Arimoto . | |
| 4,611,189 | * | 9/1986 | Mikulecky | 335/37 |
| 5,057,654 | * | 10/1991 | Meyer et al. | 200/146 R |
| 5,847,630 | | 12/1998 | Arnold et al. . | |

* cited by examiner

*Primary Examiner*—Lincoln Donovan
(74) *Attorney, Agent, or Firm*—Michael R. Swartz

(57) ABSTRACT

A load break interrupter includes a case, an arc-suppressing tube mounted on and projecting outwardly from the case, a shunt circuit rod slidably supported in the tube with the rod and tube having electrical contacts mounted thereto and convertible between make and break conditions upon sliding of the rod into and from the tube, and a shunt circuit break actuating mechanism disposed in the case and coupled with a leading end of the rod extending into the case such that upon tripping of the actuating mechanism from a shunt circuit-defining position to a shunt circuit-breaking position the rod is pulled partially into the case from the tube thereby breaking the shunt circuit through the rod and between the electrical contacts such that any arcing that occurs upon breaking of the shunt circuit is confined and suppressed inside the tube. The interrupter also includes a reset spring coupled between the case and actuating mechanism and adapted to return the actuating mechanism to the shunt circuit-defining position after each tripping thereof. The case is split diagonally and has a housing to which the arc-suppressing tube is attached and a cover adapted to attach to and form a closed interior chamber with the housing in which the actuating mechanism is disposed. The housing and cover have elements which extend into the interior chamber and cooperate together to mount and retain the actuating mechanism and reset spring and to guide movement of the shunt circuit rod. The tube includes an outer protective sleeve and an inner quench liner mechanically interlocked with the outer sleeve and a vented muffler assembly is mounted on a terminal end of the tube.

13 Claims, 8 Drawing Sheets

LOAD BREAK INTERRUPTER HAVING SHUNT CIRCUIT BREAK ACTUATING MECHANISM

CROSS REFERENCE TO RELATED APPLICATIONS

The following copending applications assigned to the same assignee as this application disclose related subject matter:

(1) Ser. No. 09/454,575, filed Dec. 7, 1999, entitled "Load Break Interrupter Having Diagonally Split Case With Component Mounting Elements" by Brad W. Davis.

(2) Ser. No. 09/454,574, filed Dec. 7, 1999, entitled "Load Break Interrupter Having Arc-Suppressing Tube With Mechanically Interlocked Inner Quench Liner" by Brad W. Davis.

(3) Ser. No. 09/454,573, filed Dec. 7, 1999, entitled "Load Break Interrupter Having Vented Muffler Assembly On Arc-Suppressing Tube" by Brad W. Davis.

BACKGROUND OF THE INVENTION

1. Field of the Invention

The present invention generally relates to a load break interrupter for suppressing arcing during opening of a blade-type disconnect switch and, more particularly, is concerned with such an interrupter having a shunt circuit break actuating mechanism.

2. Description of the Prior Art

In the use of high voltage electrical transmission and distribution equipment, it is common practice to provide manually operable blade-type switches which can be opened as needed to break the flow of current in order that linemen can work on such equipment. These switches employ a pivotally movable blade-like contact electrically connected between a pair of fixed switch terminal contacts. When the movable contact of the switch is swung open by means of a conventional hot-line tool or the like, the circuit between the fixed terminal contacts is broken and the flow of current is interrupted. The fixed and movable contacts are in proximal relationship during opening and closing of the movable contact and the swinging movement of the movable contact away from the fixed contacts is slow relative to the current flow.

Because transmission and distribution lines carrying high voltages on the order of 15,000 volts or more will produce arcing which is damaging to the blade-type switch as the movable contact is swung away from the fixed contacts, it is also common practice to employ load break interrupters with such blade-type switches. One load break interrupter marketed under the trademark DuoGap by Hubbell Power Systems, Inc. of Centralia, Mo., a subsidiary of Hubbell Incorporated, is designed to overcome the problems associated with arcing across switch contacts. The Hubbell DuoGap interrupter is illustrated and described in detail in U.S. Pat. No. 4,013,852 to Roberts et al. The Hubbell DuoGap interrupter basically includes a case, an arc-suppressing tube supported on the housing, a reciprocal shunt circuit rod slidably supported in the tube, electrical contacts spaced apart from one another on the rod and tube, and a spring-loaded trip mechanism disposed in the housing and coupled with the rod. Actuation of the trip mechanism pushes the rod through and relative to the tube to break an electrical shunt circuit between the electrical contacts on the rod and on the tube after the movable contact of the blade-type switch has separated from the fixed contacts thereof. Any arcing between the spaced apart electrical contacts on the interrupter rod and tube is confined to and suppressed inside the tube due to the presence of arc-suppressing material therein. The interrupter also includes a mechanism for resetting the interrupter to re-establish the shunt circuit through the interrupter after each actuation thereof.

The above-described Hubbell interrupter has performed highly satisfactorily over a prolonged period of commercial use. However, as with any successful product, the need arises from time to time to make improvements which will enhance its overall manufacture and operation.

SUMMARY OF THE INVENTION

The present invention provides a load break interrupter incorporating improved features that satisfies the aforementioned need. These features are a diagonally split case having component mounting elements, a shunt circuit break actuating mechanism, an arc-suppressing tube having a mechanically interlocked inner quench liner, and a vented muffler assembly on the arc-suppressing tube. One of these features, the shunt circuit break actuating mechanism, constitutes the present invention of this application. This feature along with the other features constituting the inventions of the applications cross-referenced above increase reliability of the interrupter and simplify the manner of assembly and reduce the cost of the interrupter.

Accordingly, the present invention is directed to a load break interrupter which comprises: (a) a case defining an interior chamber; (b) an arc-suppressing tube supported on and extending outwardly from the case; (c) a shunt circuit rod slidably supported in the tube for making and breaking a shunt circuit upon sliding of the rod into and from the tube; (d) a shunt circuit break actuating mechanism disposed in the interior chamber of the case and coupled with the rod such that tripping of the actuating mechanism from a shunt circuit-defining position to a shunt circuit-breaking position pulls the rod at least partially into the case from the tube thereby breaking the shunt circuit such that any arcing that occurs upon breaking of the shunt circuit is confined and suppressed inside the tube; and (e) a reset spring coupled between the case and shunt circuit break actuating mechanism and being adapted to return the actuating mechanism to the shunt circuit-defining position from the shunt circuit-breaking position such that the actuating mechanism pushes the rod from the case back into the tube thereby remaking the shunt circuit.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
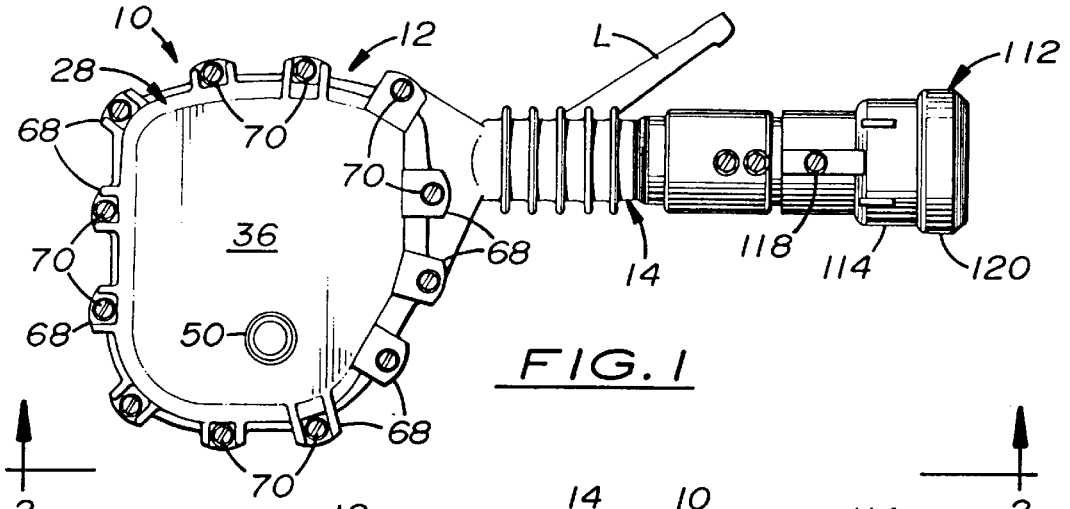
FIG. 1 is a plan view of a load break interrupter having the improvements constituting the present invention and the inventions of the applications cross-referenced above, with an external lever shown mounted on a housing of a case of the interrupter and adapted to be pivoted by a switch blade or contact of an external blade-type switch as described in the background hereinbefore.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

Load Break Interrupter—In General

Referring to the drawings and particularly to FIGS. 1 to 6, there is illustrated a load break interrupter, generally designated 10, incorporating several improved features. These improved features are a diagonally split case with component mounting elements, a shunt circuit break actuating mechanism, an arc-suppressing tube having a mechanically interlocked inner quench liner, and a vented muffler assembly on the arc-suppressing tube. Only one of these features, the shunt circuit break actuating mechanism, is the subject of the present invention. However, all such features are described hereinafter to facilitate an overall understanding of the interrupter 10.

Figure 34:
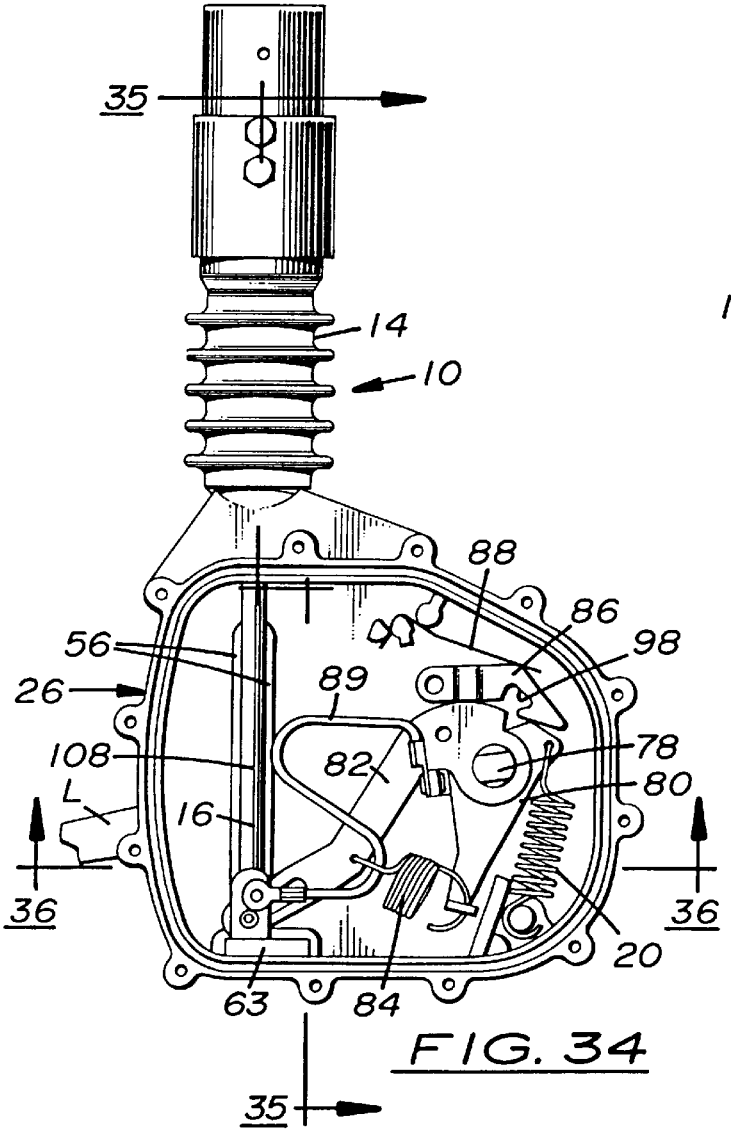
FIG. 34 is a plan view similar to that of FIG. 32, now showing the interrupter in its actuated shunt circuit-breaking position after tripping of the actuating mechanism of the interrupter, the external lever being shown in a fully displaced position after the shunt circuit rod has been pulled into the case from the arc-suppressing tube.

The load break interrupter 10 basically includes a case 12, an arc-suppressing tube 14, a shunt circuit rod 16, a shunt circuit break actuating mechanism 18 and a reset element 20. The tube 14 is mounted on and projects outwardly from the case 12. The shunt circuit rod 16 is slidably supported in the tube 14 with the tube 14 and rod 16 having respective electrical contacts 22, 24 attached thereto and convertible between make and break conditions upon sliding of the rod 16 into and from the tube 14. The shunt circuit break actuating mechanism 18 is disposed in the case 12 and coupled with a leading end 16A of the rod 16 which extends into the case 12 such that upon tripping the actuating mechanism 18 from a shunt circuit-defining position (FIG. 28) to a shunt circuit-breaking position (FIG. 34) the rod 16 is pulled partially into the case 12 from the tube 14 thereby breaking a shunt circuit through the rod 16 and between the electrical contacts 22, 24 on the tube 14 and rod 16 with any arcing that occurs upon breaking the shunt circuit at the contacts 22, 24 being confined and suppressed inside the tube 14. The reset element 20 coupled between the case 12 and the actuating mechanism 18 is adapted to return the actuating mechanism 18 to the shunt circuit-defining position (FIG. 28) after each tripping thereof to the shunt circuit-breaking position (FIG. 34).

Diagonally Split Case With Component Mounting Elements

Figure 2:
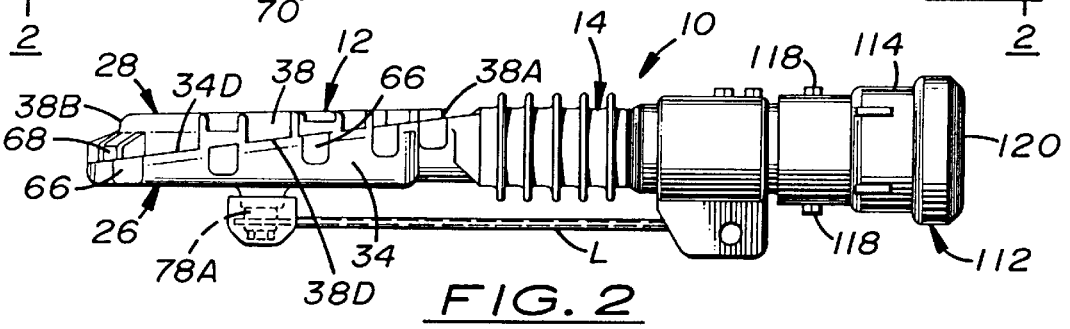
FIG. 2 is a side elevational view of the interrupter as seen along line 2—2 of FIG. 1.
Figure 3:
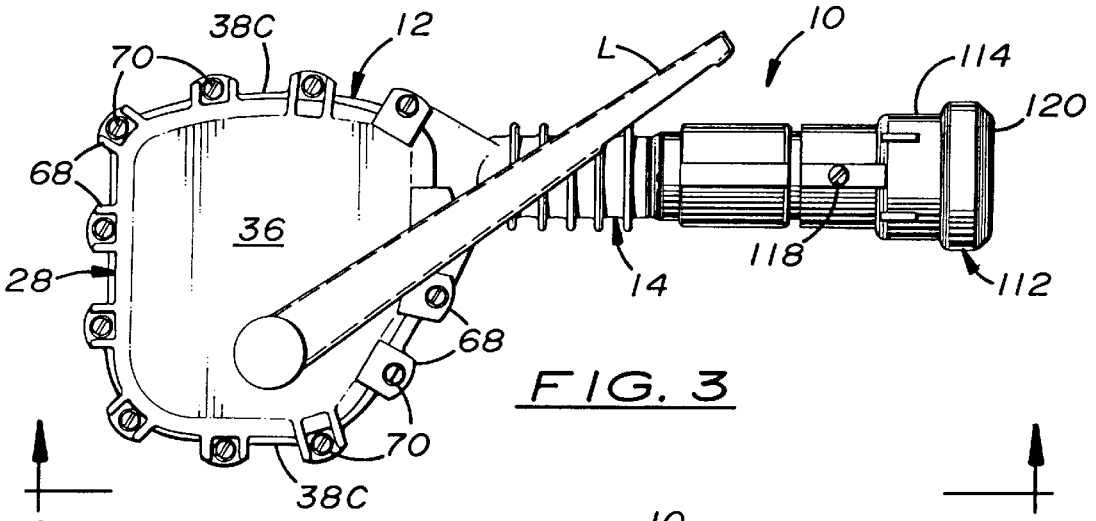
FIG. 3 is another plan view of the interrupter similar to that shown in FIG. 1 now showing the external lever mounted on a cover of the case of the interrupter.
Figure 4:
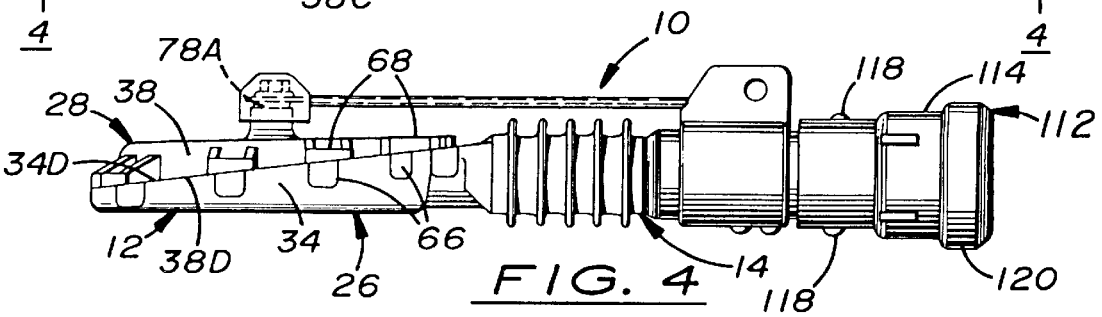
FIG. 4 is a side elevational view of the interrupter as seen along line 4—4 of FIG. 3.
Figure 5:
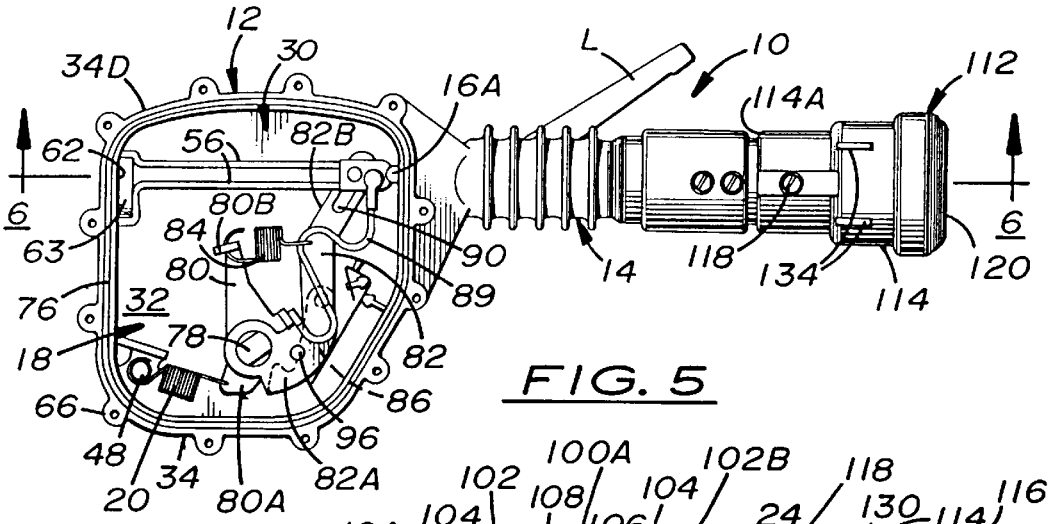
FIG. 5 is a plan view similar to that of FIG. 1 but with the cover of the case removed showing a shunt circuit break actuating mechanism disposed within the housing of the case.

Referring to FIGS. 1 to 12, the case 12 of the interrupter 10 is split diagonally and includes a housing 26 to which the arc-suppressing tube 14 is attached and a cover 28 adapted to attach to and forms a closed interior chamber 30 with the housing 26 in which the shunt circuit break actuating mechanism 18 is disposed. The housing 26 has a generally flat main wall 32 and a side wall 34 integrally attached to, projecting transversely outwardly from, and encompassing the periphery of the main wall 32. The side wall 34 of the housing 26 has a first end portion 34A located adjacent to and preferably integrally connected to the tube 14 and an opposite second end portion 34B located remote from the tube 14. As can be seen in FIG. 2, the first end portion 34A is greater in height from the main wall than the second end portion 34B such that opposite side portions 34C extending between and interconnecting the first and second end portions 34A, 34B taper from the first end portion 34A to the second end portion 34B.

The cover 28 has a generally flat main wall 36 and a side wall 38 integrally attached to, projecting transversely outwardly from, and encompassing the periphery of the main wall 36. The side wall 38 of the cover 28 has a first end portion 38A located adjacent to the tube 14 and the first end portion 34A of the housing 26 and an opposite second end portion 38B located remote from the tube 14 and adjacent to the second end portion 34B of the housing 26. As can be seen in FIG. 2, the first end portion 38A of the cover side wall 38 is smaller in height from the main wall 36 thereof than the second end portion 38B thereof such that opposite side portions 38C of the cover 38 extending between and interconnecting the first and second end portions 38A, 38B taper from the second end portion 38B to the first end portion 38A. Furthermore, the first end portion 38A of the side wall 38 of the cover 28 is smaller in height than the first end portion 34A of the side wall 34 of the housing 26 whereas the second end portion 38B of the side wall 38 of the cover 28 is larger in height than the second end portion 34B of the side wall 34 of the housing 26.

The actuating mechanism 18 is disposed in the interior chamber 30 of the case 12 formed by the housing 26 and cover 28. The housing 26 and cover 28 have respective elements formed thereon and extending into the interior chamber 30 which cooperate together to mount and retain the components of the actuating mechanism 18 and the reset element 20 and to guide movement of the shunt circuit rod 16 into and from the interior chamber 30 of the case 12. As best seen in FIG. 7, the elements formed on the main wall 32 of the housing 26 which mount the components of the actuating mechanism 18 include an annular collar 40 extending in opposite directions from the main wall 32 of the housing 26 and defining a hole 42 therethrough, posts 44 spaced in one direction from the annular collar 40, and a first boss 46 disposed between and spaced from the annular collar 40 and the posts 44. The element formed on the main wall 32 of the housing 26 which mounts the reset element 20 is a second boss 48 spaced in the opposite direction from the annular collar 40. As best seen in FIG. 7, the elements formed on the main wall 36 of the cover 28 which retain the components of the actuating mechanism 18 mounted on their respective housing elements are an annular bearing 50 aligned with and disposed adjacent to the annular collar 40 on the housing 26, a first protuberance 52 aligned with and disposed adjacent to the posts 44 on the housing 26, and a second protuberance 54 aligned with the reset element 20 and disposed adjacent to but offset from the second boss 48 on the housing 26. The elements formed on the main walls 32, 36 of the housing 26 and cover 28 which guide movement of the rod 16 are two pairs of laterally-spaced apart generally parallel rails 56, 58 aligned with and extending toward one another. The pair of rails 56 on the main wall 32 of the housing 26 at their first ends 56A are interconnected by an arcuate-shaped bight 60 disposed adjacent to the first end portion 34A of the side wall 34 of the housing 26. The pair of rails 56 at their second ends 56B together with the second end portion 34B of the side wall 34 of the housing 26 form a pocket 62 disposed adjacent to the second end portion 34B of the side wall 34 of the housing 26. A resilient impact bumper 63 (see FIG. 6) is disposed in the pocket 62 at the second ends 56B of the rails for receiving the impact of the leading end 16A of the rod 16 when pulled into the case 12 by tripping of the actuating mechanism 18.

The pair of rails 58 on the main wall 36 of the cover 28 at their first ends 58A are interconnected by an arcuate bight 64 disposed adjacent to the first end portion 38A of the side wall 38 of the cover 28. The pair of rails 58 at their second ends 58B are spaced apart from one another and disposed adjacent to the second end portion 38B of the side wall 38 of the cover 28.

The outer edges of the side walls 34, 38 of the housing 26 and cover 28 define respective annular rims 34D, 38D where they mate with one another. The housing 26 has a plurality of bosses 66 spaced apart from one another and formed on and protruding outwardly from its annular rim 34D. The cover 28 has a like plurality of lugs 68 spaced apart from one another and formed on and protruding outwardly from its annular rim 38D and aligned over the bosses 66 of the housing 26 when the cover 28 is mated on the housing 26. A plurality of fasteners 70, such as screws, are inserted through openings 72 in the cover lugs 68 and threaded into holes 74 in the housing bosses 66 to securely attach the cover 28 to the housing 26. Also, an annular gasket 76 is provided between the mated rims 34D, 38D so as to provide a seal therebetween.

The housing 26 and cover 28 of the case 12, including the above-described respective elements thereof, and the tube 14 are preferably made of a suitable plastic material and fabricated by a suitable conventional injection molding process. The housing 26 and tube 14 are molded as a single unit and the cover 28 is molded as a separate unit removably securable to the housing 26 by means of the fasteners 70 as described above.

Shunt Circuit Break Actuating Mechanism

Referring to FIGS. 5 to 24, the shunt circuit break actuating mechanism 18 of the interrupter 10 includes a drive shaft 78, a trip lever 80, an elongated link 82, a power spring 84, a latch 86 and a latch backup spring 88. The drive shaft 78 is rotatably supported between the annular collar 40 on the housing 26 and the annular bearing 50 on the cover 28 with an end 78A of the drive shaft 78 extending through the hole 42 where the external lever L is fixedly attached to the shaft 78. The trip lever 80 is fixedly attached on the drive shaft 78 and has first and second ends 80A, 80B extending in opposite directions therefrom. A shunt cable 89 is attached to and extends between the trip lever 80 and the leading end 16A of the rod 16 so as to provide the portion of the shunt circuit extending between the external lever L and the rod 16. The elongated link 82 at a first end 82A is rotatable journalled on the drive shaft 78 between the annular bearing 50 and trip lever 80 and at an opposite second end 82B has a slot 90 where it is slidably coupled to the leading end 16A of the shunt circuit rod 16 by a pin 92. The power spring 84 extends between and resiliently yieldably interconnects the first end 80A of the trip lever 80 and an intermediate location on the link 82 through an aperture 94 spaced from its first and second ends 82A, 82B. The latch 86 is pivotally mounted to the housing 26 by the first boss 46 thereon and disposed adjacent to the first end 82A of the link 82 where a pin 96 spaced a short distance from the first end 82A protrudes from the link 82 and extends into a notch 98 formed in a side of the latch 86. The latch backup spring 88 is mounted at one end between the posts 44 formed on the housing 26 and retained in such mounted position by the first protuberance 52 formed on the cover 28 extending toward the posts 44. The latch backup spring 88 can be a leaf spring which engages the latch 86 on a side thereof opposite from the notch 98 in the latch 86 which receives the pin 96 protruding from the side of the link 82 adjacent to the latch 86. The latch backup spring 88 biases the latch 86 toward the pin 96 such that the link 82 is retained by the latch 86 in the relaxed shunt circuit defining position of the actuating mechanism 18, as seen in FIG. 28.

Figure 28:
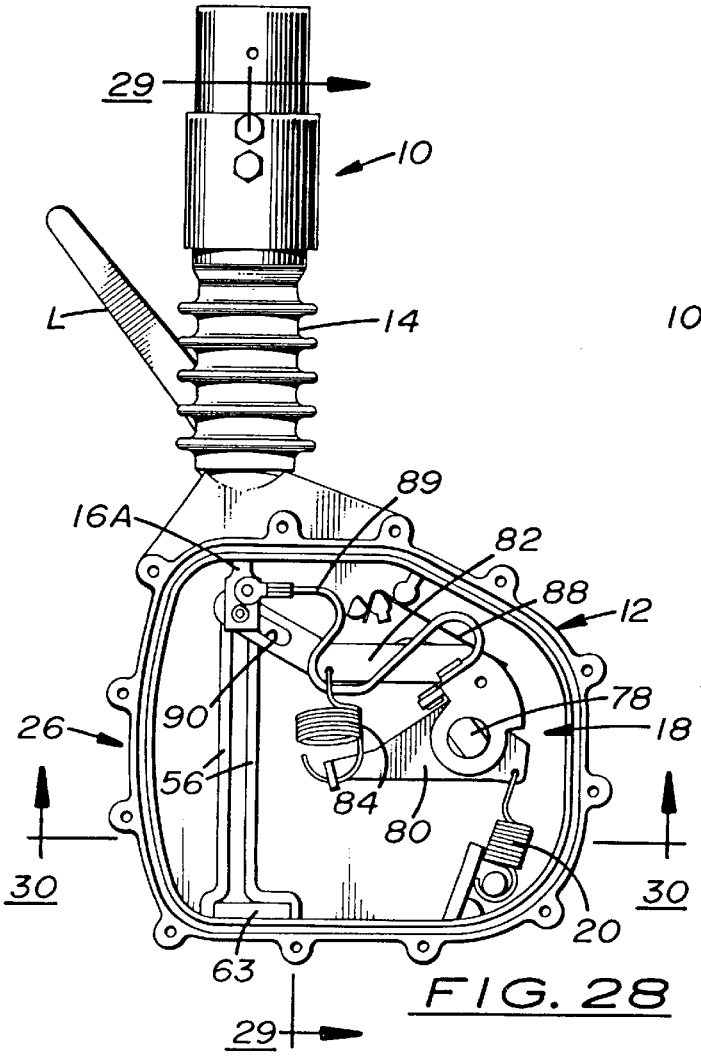
FIG. 28 is a plan view the same as that of FIG. 5, showing the interrupter in its relaxed shunt-circuit defining position, the external lever being shown in a rest position before being engaged by a movable switch blade contact of a blade-type switch.
Figure 31:
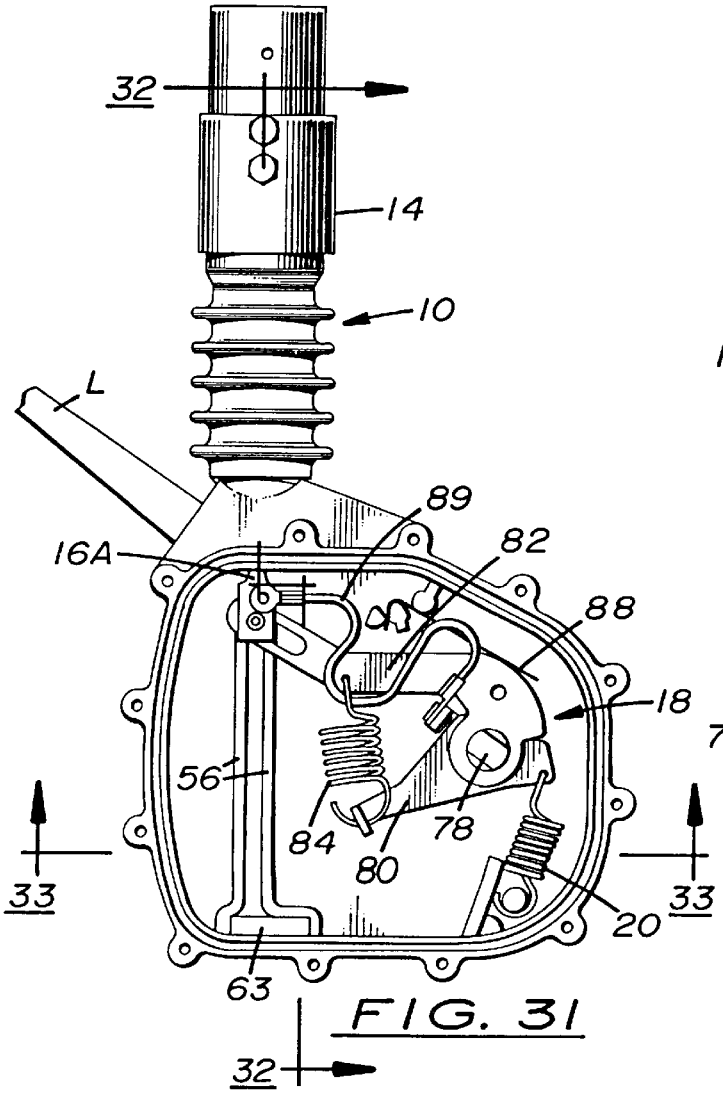
FIG. 31 is a plan view similar to that of FIG. 28, now showing the interrupter in its loaded shunt-circuit defining position prior to tripping of the actuating mechanism of the interrupter, the external lever being shown in a partially displaced position after being engaged and moved relative to the interrupter by the movement of the movable switch blade contact of the blade-type switch out of electrical connection with the fixed contacts of the switch.

The drive shaft 78 and trip lever 80 therewith are rotated counterclockwise from the relaxed shunt circuit defining position shown in FIG. 28 by counterclockwise movement of the external lever L and in response thereto the power spring 84 is expanded until the drive shaft 78 and trip lever 80 therewith reach a loaded shunt circuit defining position of the actuating mechanism 18, as seen in FIG. 31. As the drive shaft 78 and trip lever 80 therewith rotate past the loaded shunt circuit defining position of FIG. 31 with continued rotation of the external lever L, the second end 80B of the trip lever 80 engages a free end 86A of the latch 86 located adjacent to the notch 98 and lifts the latch 86 away from the pin 96 releasing the link 82 and thereby tripping the actuation mechanism 18 allowing it to move abruptly to its shunt circuit breaking position, as seen in FIG. 34. The released link 82 is now free to rotate abruptly in response to a force imposed thereon by the expanded power spring 84. Due to the imposed force of the expanded power spring 84, the link 82 abruptly rotates about the drive shaft 78 and pulls the shunt circuit rod 16 into the interior chamber 30 of the case 12 partially from the tube 14 breaking the shunt circuit.

The reset spring 20 at one end 20A is hooked about the second boss 48 formed on the housing 26 and at an opposite end 20B is hooked to the second end 80B of the trip lever 80 on the drive shaft 78. As the trip lever 80 is rotated counterclockwise with the drive shaft 78 in response to the external lever L, the reset spring 20 expands and imposes a return force on the trip lever 80. Then, once the external switch blade (not shown) is completely open and the actuating mechanism 18 has tripped as described above, in response to the external lever L disengaging from the external switch blade the expanded reset spring 20 causes reverse or clockwise rotation of the drive shaft 78 and trip lever 80 and link 82 therewith which brings the pin 96 on the link 82 into engagement with the latch 86, lifting the latch 86 against its backup spring 88 until the pin 96 is again received in the notch 98 in the latch 86. At this point the actuating mechanism 18 has returned to its relaxed shunt circuit defining position wherein the contacts 22, 24 on the tube 14 and shunt circuit rod 16 are again in electrical contact with one another. The pin 96 engages and holds the latch 86 and thereby the link 82 at the initial untripped condition wherein the rod 16 is withdrawn from the interior chamber 30 of the case 12 into the tube 14.

Figure 30:
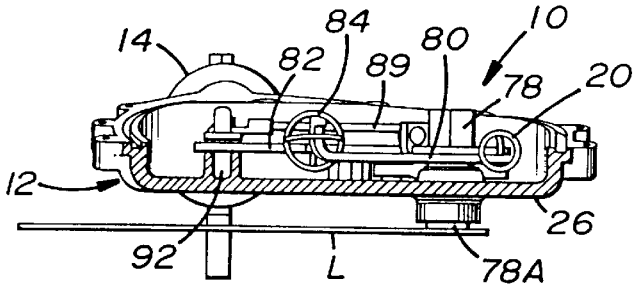
FIG. 30 is a cross-sectional view taken along line 30—30 of FIG. 28.
Figure 29:
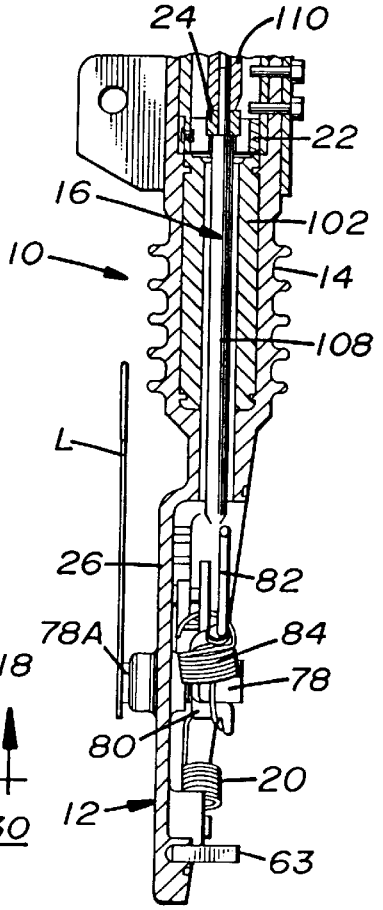
FIG. 29 is a longitudinal sectional view taken along line 29—29 of FIG. 28.
Figure 33:
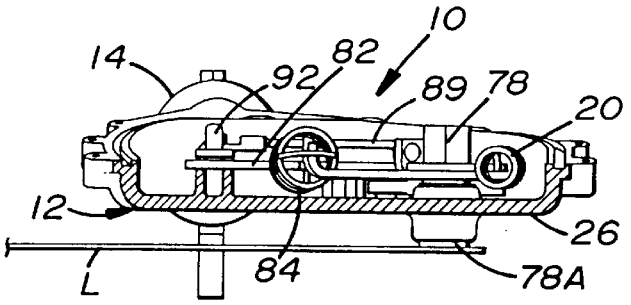
FIG. 33 is a cross-sectional view taken along line 33—33 of FIG. 31.
Figure 32:
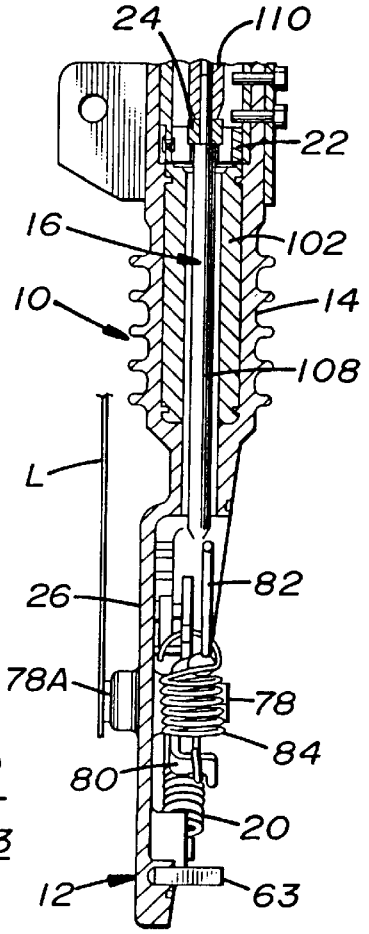
FIG. 32 is a longitudinal sectional view taken along line 32—32 of FIG. 31.
Figure 36:
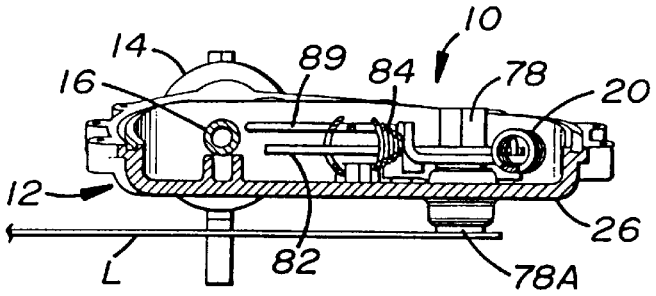
FIG. 36 is a cross-sectional view taken along line 36—36 of FIG. 34.
Figure 35:
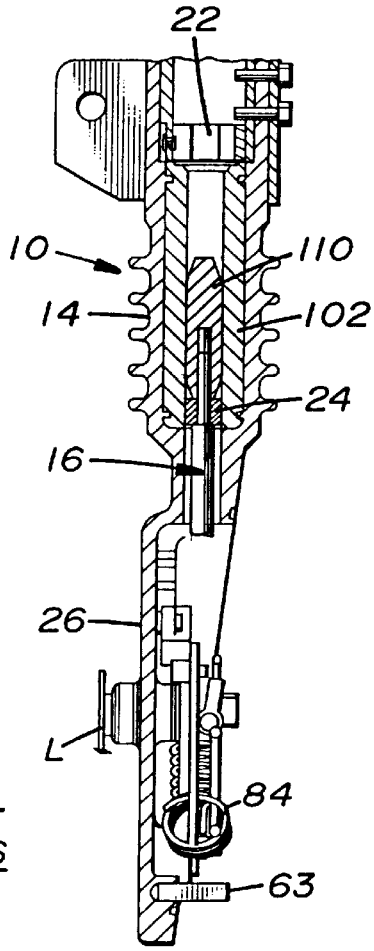
FIG. 35 is a longitudinal sectional view taken along line 35—35 of FIG. 34.

FIGS. 28 to 36 show the respective positions of the actuating mechanism 18 and the shunt circuit rod 16 of the interrupter 10 at three successive stages of its operation. FIGS. 28 to 30 show a first stage of operation wherein the actuating mechanism 18 is in the relaxed shunt-circuit defining position and the rod 16 is substantially fully disposed in the tube 14 with their contacts 22, 24 electrically contacting one another in response to the external lever L connected to the actuating mechanism 18 being disposed in a rest position before being engaged by an external switch blade (not shown) upon movement of the latter in a known manner by a linesman in the process of breaking an electrical connection of a known blade-type switch as discussed in the background hereinabove. FIGS. 31 to 33 show a second stage of operation wherein the actuating mechanism 18 has moved into the loaded shunt-circuit defining position with the rod 16 still fully in the tube 14 and the contacts 22, 24 of the tube 14 and rod 16 still electrically connected with one another, prior to the actuating mechanism 18 and rod 16 being tripped as described above, in response to the external lever L assuming a partially displaced position due to being engaged and moved by the external switch blade as the latter is moved and breaks electrical connection with the fixed contacts of the blade-type switch so that line current is then fully transferred through the shunt circuit of the interrupter 10 before the electrical connection is broken through the blade-type switch. And FIGS. 34 to 36 show a third stage of operation wherein the actuating mechanism 18 is moved into the shunt circuit-breaking position, the rod 16 partially pulled from the tube 14, and the contacts 22, 24 of the tube 14 and rod 16 disconnected from one another after tripping of the actuating mechanism 18 as described above, in response to the external lever L assuming a fully displaced position due to being further moved by the external switch blade.

Mechanically Interlocked Inner Quench Liner

Figure 6:
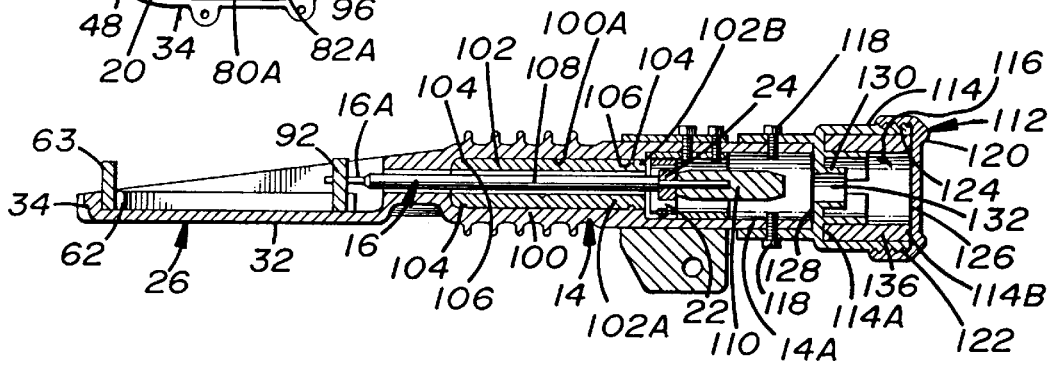
FIG. 6 is a longitudinal sectional view of the interrupter taken along line 6—6 of FIG. 5.
Figure 7:
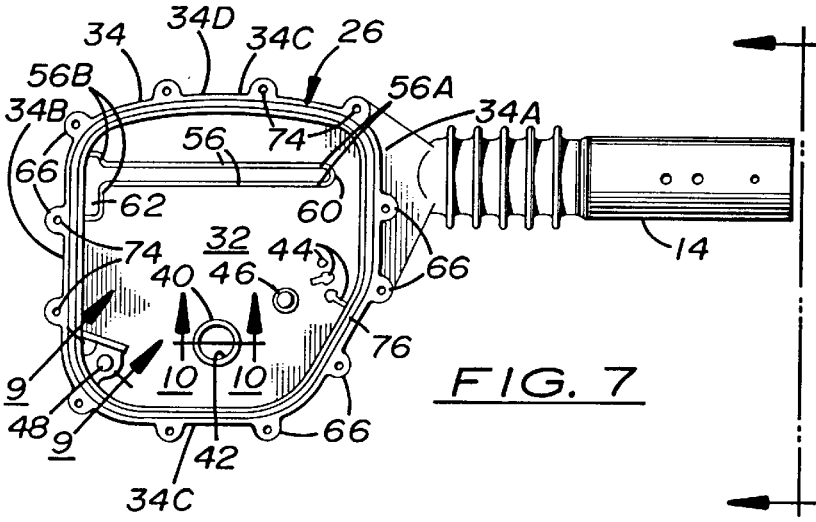
FIG. 7 is a plan view similar to that of FIG. 5 but with the actuating mechanism removed from the housing of the case.
Figure 8:
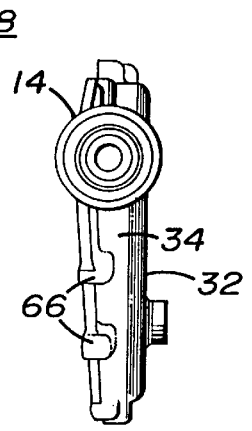
FIG. 8 is an end view of the housing of the case as seen along line 8—8 of FIG. 7.
Figure 9:
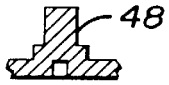
FIG. 9 is a fragmentary cross-sectional view taken along line 9—9 of FIG. 7 showing a spring anchor post formed on the housing about which is hooked an end of a reset spring employed by the interrupter.
Figure 10:
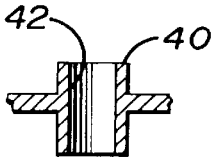
FIG. 10 is a fragmentary cross-sectional view taken along line 10—10 of FIG. 7 showing a collar formed on the housing defining a hole for receiving and mounting a rotatable shaft of the actuating mechanism.
Figure 11:
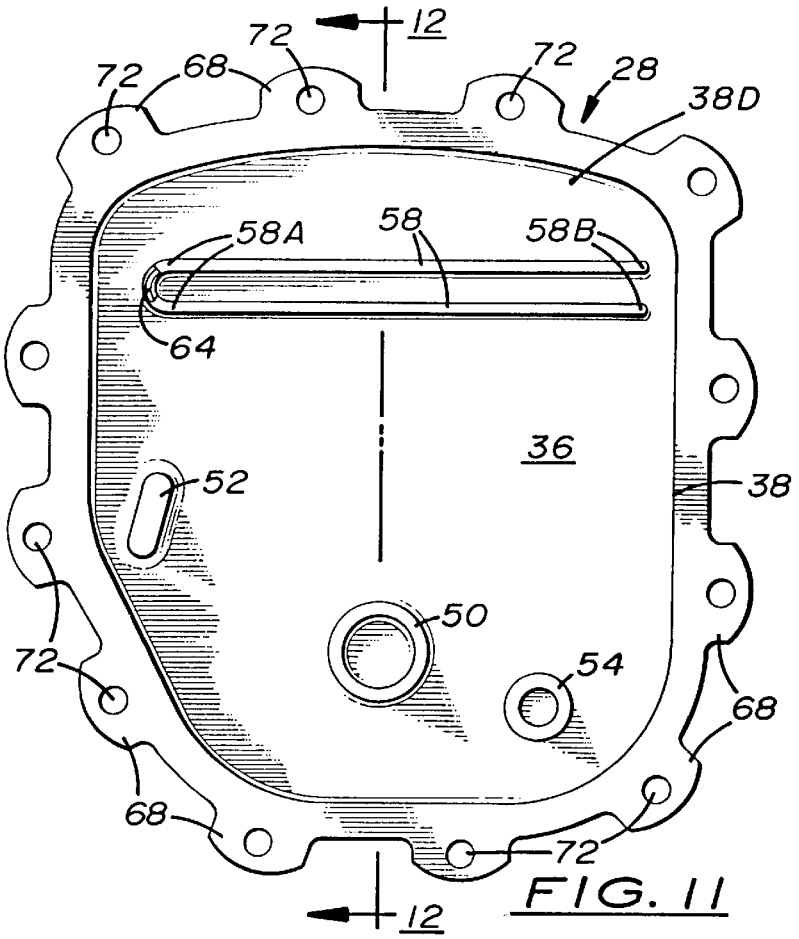
FIG. 11 is an enlarged plan view of the cover of the interrupter case.
Figure 12:
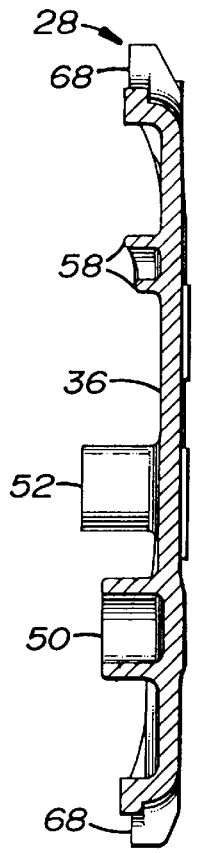
FIG. 12 is a cross-sectional view of the cover taken along line 12—12 of FIG. 11.
Figure 13:
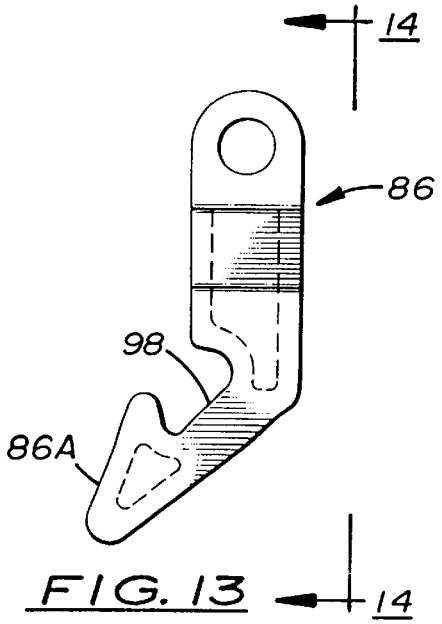
FIG. 13 is an enlarged side elevational view of a latch of the interrupter actuating mechanism.
Figure 14:
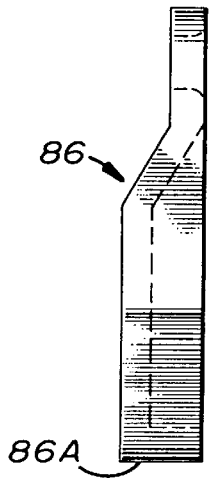
FIG. 14 is an end elevational view of the latch as seen along line 14—14 of FIG. 13.
Figure 26:
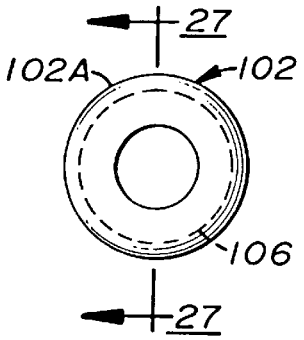
FIG. 26 is an enlarged end elevational view of an arc quench liner of the arc suppressing tube of the interrupter.
Figure 27:
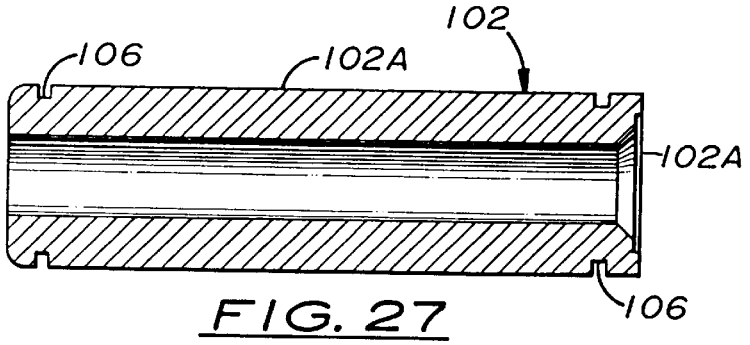
FIG. 27 is a longitudinal sectional view of the liner taken along line 27—27 of FIG. 26.
Figure 16:
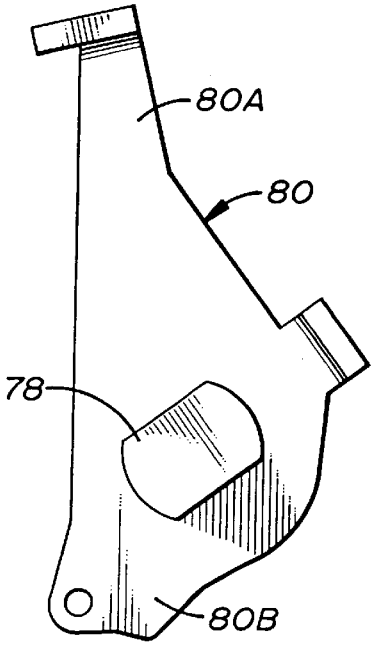
FIG. 16 is an end elevational view of the drive assembly as seen along line 16—16 of FIG. 15.
Figure 15:
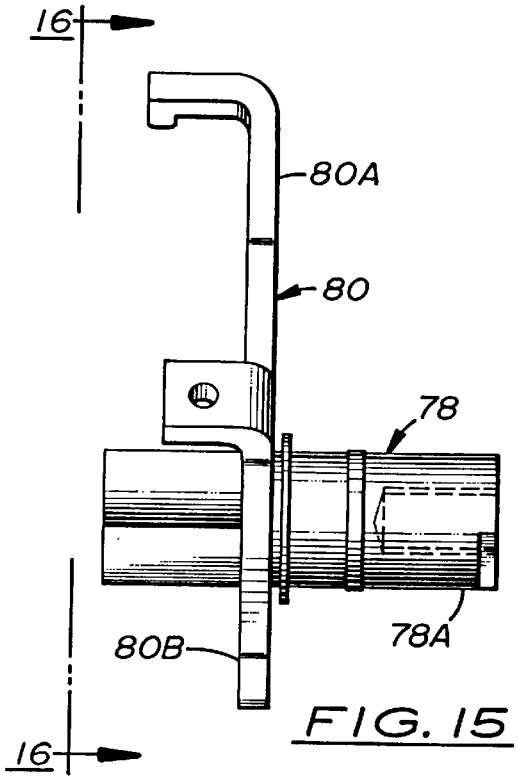
FIG. 15 is an enlarged side elevational view of a drive assembly of the interrupter actuating mechanism.
Figure 18:
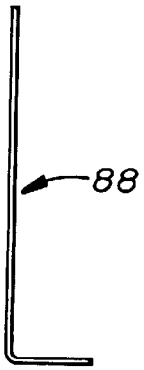
FIG. 18 is a side elevational view of the latch backup spring as seen along line 18—18 of FIG. 17.
Figure 17:
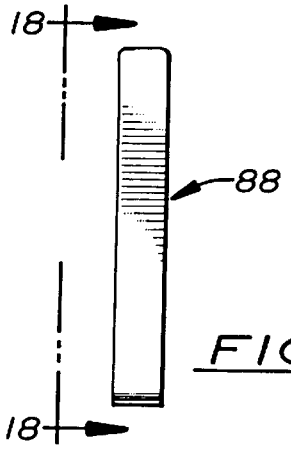
FIG. 17 is an enlarged plan view of a latch backup spring of the interrupter actuating mechanism.
Figure 19:
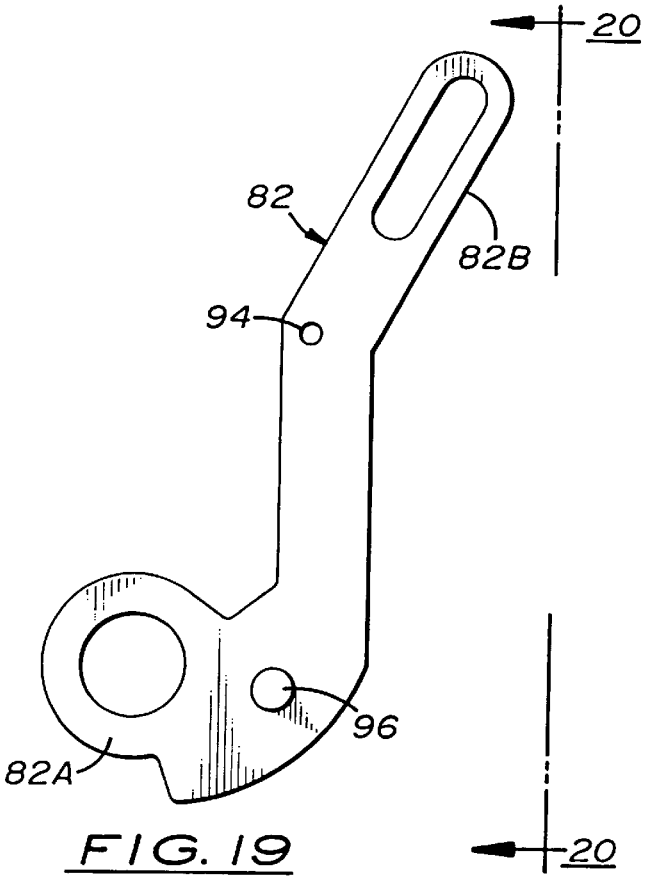
FIG. 19 is an enlarged plan view of a lever of the interrupter actuating mechanism.
Figure 20:
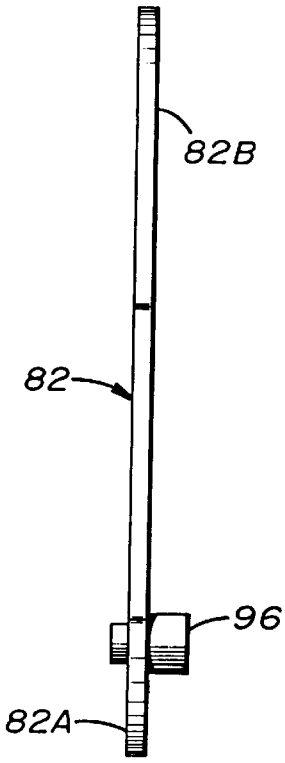
FIG. 20 is a side elevational view of the lever as seen along line 20—20 of FIG. 19.
Figure 25:
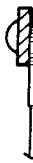
FIG. 25 is an end elevational view as seen along line 25—25 of FIG. 24 showing a connector on a shunt cable attached to a leading end of the shunt circuit rod.
Figure 24:
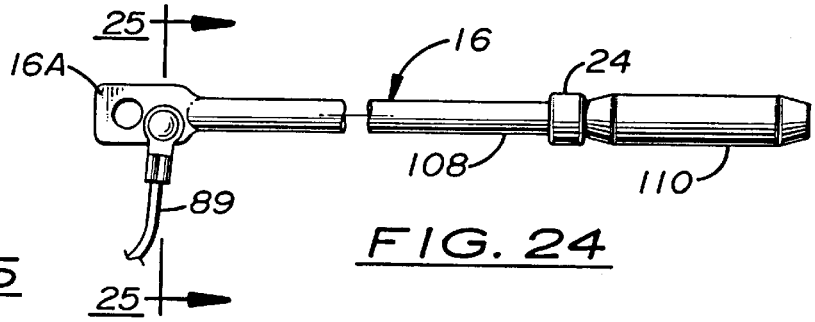
FIG. 24 is an enlarged side elevational view of a shunt circuit rod of the interrupter.
Figure 23:
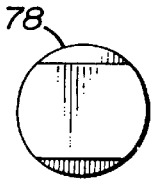
FIG. 23 is an opposite end elevational view of the drive shaft as seen along line 23—23 of FIG. 21.
Figure 21:
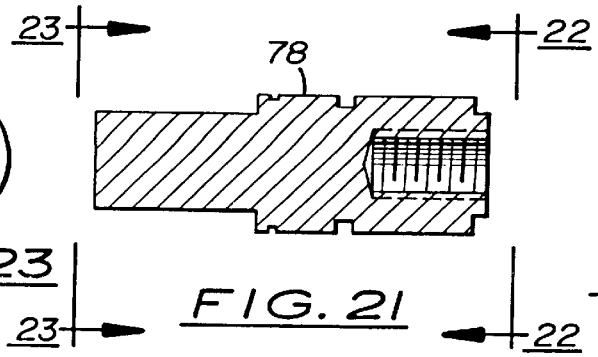
FIG. 21 is a longitudinal sectional view of a drive shaft of the drive assembly of FIG. 15.
Figure 22:
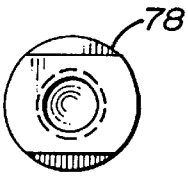
FIG. 22 is an end elevational view of the drive shaft as seen along line 22—22 of FIG. 21.

Referring to FIGS. 6, 26 and 27, the arc-suppressing tube 14 includes an outer protective sleeve 100 and an inner quench liner 102 mechanically interlocked with the outer sleeve 100. The outer sleeve 100 includes a pair of annular ridges 104 spaced apart from one another and defined on an interior annular surface 100A of the sleeve 100 so as to project radially inwardly therefrom. The inner liner 102 includes a pair of annular grooves 106 spaced apart from one another, disposed adjacent to opposite ends of the liner 102 and defined in an exterior annular surface 102A of the liner 102 so as to project radially inwardly therefrom and receive in an interlocking fashion the annular ridges 104 on the sleeve 100. The inner liner 102 preferably is molded into the outer sleeve 100 and is made of acetal material.

The shunt circuit rod 16 which extends through the tube 14 includes an elongated plunger portion 108 disposed through and inwardly spaced from the liner 102 when the rod 16 is substantially fully withdrawn into the tube 14 and an arc quenching trailing end portion 110 connected to one end of the plunger portion 108. The trailing end portion 110 is substantially shorter in length than the plunger portion 108 and preferably is made of acetal. The rod 16 has the annular electrical contact 24 surrounding and attached on the plunger portion 108 adjacent to the trailing end portion 110. The tube 14 has the electrical contact 22 supported therein adjacent to the one end 102B of the liner 102 and surrounding and electrically contacting the electrical contact 24 on the rod 16 when the rod 16 is substantially fully withdrawn into (or disposed within) the tube 14.

Vented Muffler Assembly

Referring again to FIGS. 1 to 6, the interrupter 10 further includes a vented muffler assembly 112 mounted on a terminal end 14A of the arc-suppressing tube 14. The muffler assembly 112 includes a tubular body 114 having opposite inner and outer ends 114A, 114B and a central cavity 116 extending between the opposite ends 114A, 114B. The tubular body 114 is adapted to slidably fit at its inner end 114A over the terminal end 14A of the tube 14 and to be secured thereto by means of screws 118.

The muffler assembly 112 further includes an end cap 120 and complementary exterior threads 122 on the outer end 114B of the tubular body 114 and interior threads 124 on the end cap 120 for removably securing the end cap 120 on the outer end 114B of the tubular body 114. A disc 126 made of stainless steel material is disposed between the end cap 120 and the outer end 114B of the tubular body 114 for shielding the end cap 120 from contact with the arc generated gases in the tube 14.

The muffler assembly 112 still further includes an annular wall 128 and an annular ring 130 attached on the annular wall 128. The annular wall 128 is disposed inside the tubular body 124, extending transversely to the tubular body 114 and partially across the central cavity 116 thereof. The annular wall 128 defines an opening 132 through it. The annular ring 130 is spaced from the end cap 120 and attached on the annular wall 128, surrounding the opening 132 therein and spaced inwardly from the tubular body 114. The tubular body 114 has spaced side openings 134 defined therein outwardly from the annular ring 130 such that a path for escape of gases from the tube 14 into the muffler assembly 112 proceeds through the cavity 116 of the tubular body 114, through the opening 132 of the annular wall 128, past the annular ring 130 and then radially outwardly through the cavity 116 of the tubular body 114 to the side openings 134 therein. Finally, the muffler assembly 112 includes a roll 136 of porous mesh disposed in the cavity 116 between the annular wall 128 and the end cap 120 and surrounding the annular ring 130 such that the escape path of gases also goes through the roll 136 of porous mesh. The porous mesh 136 is preferably a stainless steel material and in the form of a continuous coiled roll. Preferably, the coiled mesh roll 136 is formed by wrapping a length of continuous mesh material onto a non-circular (hex) shaft (not shown) in forming a coiled roll. Since the mesh material retains a spring action due to its memory, when the coiled roll 136 is slide into the muffler 112, it springs radially outwardly against the inner diameter of the tubular body 114 resulting in a slight separation of the layers of mesh material so as to provide a desired gas flow rate through the porous mesh roll 136. The muffler assembly 112 having the foregoing construction creates a back pressure providing the proper balance of gas pressure between the muffler cavity 116 and the interior chamber 30 and enhances the life of the inner liner 102 of the tube 14. The side openings 134 on the tubular body 114 while allowing passage of vented gases substantially prevents entry of water into the tube 14 via the muffler assembly 112.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A load break interrupter, comprising:

(a) a case defining an interior chamber;

(b) an arc-suppressing tube supported on and extending outwardly from said case;

(c) a shunt circuit rod slidably supported in said tube for making and breaking a shunt circuit upon sliding of said rod into and from said tube;

(d) a shunt circuit break actuating mechanism disposed in said interior chamber of said case and coupled with a leading end of said rod such that tripping of said actuating mechanism from a shunt circuit-defining position to a shunt circuit-breaking position pulls said rod at least partially into said case from said tube thereby breaking the shunt circuit such that any arcing that occurs upon breaking of said shunt circuit is confined and suppressed inside said tube, said shunt circuit break actuating mechanism including (i) a drive shaft rotatably supported in said interior chamber between opposite sides of said case, p2 (ii) a trip lever fixedly attached on said drive shaft and having opposite first and second ends extending in opposite directions therefrom, (iii) a link at one end rotatable journalled on said drive shaft and at an opposite end being slidably coupled to a leading end of said shunt circuit rod, said link including a pin protruding therefrom adjacent to said one end of said link, and (iv) a power spring extending between and resiliently yieldably interconnecting said first end of said trip lever and an intermediate location on said link spaced from said first and second ends thereof; and (e) a reset spring coupled between said case and shunt circuit break actuating mechanism and being adapted to return said actuating mechanism to said shunt circuit-defining position from said shunt circuit-breaking position such that said actuating mechanism pushes said rod from said case back into said tube thereby remaking the shunt circuit.

2. The interrupter as recited in claim 1, wherein said drive shaft has an end which can protrude from said case at either of said opposite sides thereof so as to attach an external lever thereon.

3. The interrupter as recited in claim 1, wherein said shunt circuit breaking actuating mechanism further includes a shunt cable attached to and extending between said trip lever and said leading end of said rod.

4. The interrupter as recited in claim 1, wherein said shunt circuit break actuating mechanism further includes a latch pivotally mounted to said casing and disposed adjacent to said one end of said link, said latch having a notch defined in a first side thereof receiving said pin protruding from said link.

5. The interrupter as recited in claim 4, wherein said shunt circuit break actuating mechanism further includes means engaging said latch on a second side thereof opposite from said notch and biasing said latch toward said pin such that said link and therewith said shunt circuit rod are retained in said shunt circuit defining position of said actuating mechanism even as the drive shaft rotates and expands said power spring.

6. The interrupter as recited in claim 5, wherein said second end of said trip lever, as said drive shaft and trip lever therewith are rotated, is adapted to engage said latch and lift said latch off said pin releasing said link and thereby trip said actuation mechanism to move to said shunt circuit breaking position, said released link now free to rotate in response to a force imposed thereon by said expanded power spring and pull said shunt circuit rod at least partially into said interior chamber of said case breaking the shunt circuit.

7. The interrupter as recited in claim 6, wherein as said released link rotates pulling said shunt circuit rod said reset spring expands and imposes a return force on said trip lever causing reverse rotation of said drive shaft and said link therewith until said pin on said link is returned into engagement with said latch and lifts said latch against said backup spring until said pin is again received in said notch in said latch and said actuating mechanism is returned to and retained at said shunt circuit defining position with said pin engaging and holding said latch and thereby said link at an initial untripped position and said shunt circuit rod withdrawn into said tube.

8. The interrupter as recited in claim 1, wherein said shunt circuit rod and said tube have contact means thereon convertible between make and break conditions upon sliding of said rod into and from said tube by said actuating mechanism.

9. The interrupter as recited in claim 1, wherein said case includes a matable housing and cover with respective elements formed thereon which extend into said interior chamber and cooperate together so as to mount components of said shunt circuit break actuating mechanism.

10. The interrupter as recited in claim 1, wherein said case includes a matable housing and cover with respective guide elements formed thereon which extend into said interior chamber, are aligned with said tube and cooperate together so as to guide movement of said shunt circuit rod in said interior chamber.

11. The interrupter as recited in claim 10, wherein said casing further includes a resilient impact bumper disposed in said interior chamber between said housing and cover at an end of said guide elements located remote from said tube.

12. The interrupter as recited in claim 10, wherein said guide elements are two laterally-spaced apart rails formed on each of said cover and housing, said two rails on said cover being aligned with and extending toward said two rails on said housing.

13. The interrupter as recited in claim 12, wherein said casing further includes a resilient impact bumper disposed in said interior chamber between said housing and cover at an end of said rails located remote from said tube.

* * * * *